US006450424B1

(12) United States Patent
Horbelt

(10) Patent No.: US 6,450,424 B1
(45) Date of Patent: Sep. 17, 2002

(54) ELECTROMAGNETICALLY ACTUATED VALVE

(75) Inventor: Michael Horbelt, Vaihingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/601,521

(22) PCT Filed: Aug. 7, 1999

(86) PCT No.: PCT/DE99/02474

§ 371 (c)(1),
(2), (4) Date: Nov. 15, 2000

(87) PCT Pub. No.: WO00/32925

PCT Pub. Date: Jun. 8, 2000

(30) Foreign Application Priority Data

Dec. 2, 1998 (DE) ..... 198 55 547

(51) Int. Cl.[7] ..... F02M 51/00; B05B 1/30

(52) U.S. Cl. ..... 239/585.1; 239/583; 239/584; 239/585.2; 239/585.3; 239/585.4; 239/585.5; 251/129.19

(58) Field of Search ..... 239/583, 584, 239/585.1, 585.2, 585.3, 585.4, 585.5; 251/129.19

(56) References Cited

U.S. PATENT DOCUMENTS 3,871,615 A * 3/1975 Donner ..... 251/129.19
4,417,693 A 11/1983 Fuessner et al.
5,203,538 A 4/1993 Matsunaga et al.
5,299,776 A 4/1994 Brinn et al.
5,984,210 A * 11/1999 Forck et al. ..... 239/585.1

FOREIGN PATENT DOCUMENTS

DE 33 14 899 A1 10/1984
GB 2 196 181 A 4/1988
JP 59 201966 A 11/1984

* cited by examiner

*Primary Examiner*—Lesley D. Morris
*Assistant Examiner*—Robin O. Evans
(74) *Attorney, Agent, or Firm*—Kenyon & Kenyon

(57) ABSTRACT

An electromagnetically actuated valve (1) has a core (5), a solenoid coil (8) and an armature that can be acted upon by the solenoid coil (8) in a stroke direction in opposition to a restoring spring (27), and a valve needle (13). The valve needle (13) is fixedly joined both to the armature (11) as well as to a valve-closure member, which cooperates with a fixed valve seat, and constitutes a movable valve element. On the valve needle (13), between the armature (11) and the valve-closure member, an auxiliary body (30) is arranged, which is movable relative to the valve needle (13). The valve needle (13) is designed as having a driving arrangement (34) such that, in response to a motion of the auxiliary body (30) in the stroke direction, the valve needle (13) can be accelerated in the same direction by energy transfer, and a rapid opening of the valve is realized.

9 Claims, 4 Drawing Sheets

ELECTROMAGNETICALLY ACTUATED VALVE

FIELD OF THE INVENTION

The invention relates to an electromagnetically actuated valve according to the species of the main claim.

BACKGROUND INFORMATION

Electromagnetically actuated valves are already known in the form of fuel injection valves, in which, for the purpose of reducing in the valve seat area the rebound behavior of a valve-closure member that is connected to a valve needle, and thus to avoid unwanted openings of the valve, a magnet armature is arranged on the valve needle so as to be relatively movable in relation to it.

German Patent Application No. 33 14 899 describes an electromagnetically actuated fuel injection valve, in which, for electromagnetic actuation, a magnet armature cooperates with an electrically excitable solenoid coil, and the stroke of the magnet armature is transmitted via a valve needle to a valve-closure member. To form a valve seal, the valve-closure member cooperates with a valve seat. The magnet armature is not rigidly secured on the valve needle, but is arranged so as to be movable in the axial direction relative to the valve needle. A first restoring spring acts upon the valve needle in the closing direction and therefore keeps the injection valve closed in the zero-current, nonexcited state of the solenoid coil. The magnet armature is acted upon in the stroke direction by a second restoring spring such that the magnet armature, in the resting position, contacts a first limit stop provided on the valve needle. In response to the excitation of the solenoid coil, the magnet armature is pulled in the stroke direction and, via the first limit stop, takes the valve needle with it. When the current exciting the solenoid coil is switched off, the valve needle is accelerated in its closing position by the first restoring spring and, via the described limit stop, takes the armature with it. As soon as the valve-closure member contacts the valve seat, the closing motion of the valve needle is abruptly terminated. The motion of the magnet armature, which is not rigidly connected to the valve needle, continues opposite to the stroke direction and it is absorbed by the second restoring spring, i.e., the magnet armature swings through against the second restoring spring, having a significantly weaker spring tension in comparison to the first restoring spring. Finally, the second restoring spring accelerates the magnet armature once again in the stroke direction. If the magnet armature meets the limit stop of the valve needle, this can lead to a new short-term lifting off from the valve seat of the valve-closure member, that is joined to the valve needle, and therefore to a short-term opening of the valve.

German Patent Application No. 33 14 899 describes a fuel injection valve having an armature that is fixedly joined to the valve needle, and a movable auxiliary mass. In this valve, two restoring springs are provided, specifically a first restoring spring as a spiral spring for the valve needle having the armature, and a second restoring spring as a disk spring for the auxiliary mass. The auxiliary mass, in the closed state of the valve, contacts a valve body that is fixed to the housing, so that between a limit stop disk of the valve needle and the auxiliary mass a distance remains when the valve is closed. After switching on the exciting current, the armature and therefore the valve needle rigidly joined to it are pulled against the force of the spiral spring. After one portion of the valve needle path has been traversed, the limit stop disk of the valve needle impacts against the auxiliary mass, the spring tension of the spiral spring adding to the spring tension of the disk spring. Towards the end of the pulling motion, the armature strikes against the magnetic pole and rebounds. The auxiliary mass can continue its motion against the force of the disk spring, as a result of which pressure is removed from the armature and a high excess of magnetic force is made available for braking the rebound motion. After switching off the magnet, the armature, or the valve needle, is reset by the combined force of the two springs.

In U.S. Pat. No. 5,299,776, connection with reducing the rebound action, describes joining the magnet armature to the valve needle in a nonrigid fashion, but rather to make it possible for the magnet armature to have a certain axial play at the valve needle. However, the axial position of the magnet armature in the resting position of the fuel injection valve is not defined in this embodiment, and therefore, in the valve, the response time in switching on the exciting current is undetermined.

Independent of electromagnetically actuated valves of this type having a magnet armature that is axially movable on the valve needle, for reducing or eliminating the rebound of the valve needle on the valve seat, electromagnetically actuated valves, e.g., in the form of fuel injection valves, are conventional, in which the magnet armature, the valve needle, and the valve-closure member constitute a rigid, axially movable valve element. In conventional valves of this type, often used for fuel injection in motor vehicles, one of the most essential objectives lies in accelerating this valve element as quickly as possible (in the order of magnitude of 0.2 to 1 ms) from the resting position, contacting the valve seat in the closed position of the valve. For this purpose, in the driving phase, a very high energy momentum must be applied, which makes necessary a short-term, very high booster current of significantly greater than 10 A at 120 V, for pulling the valve needle loose. This high booster current for its part can only be achieved in such valves using extraordinary electrical measures (costly electronic circuitry). These measures become all the more comprehensive, the higher the fuel counterpressure is (e.g., in direct fuel injection).

SUMMARY

The electromagnetically actuated valve according to the present invention has the advantage that the valve needle is pulled loose and therefore the opening of the valve takes place in at least the same time or even faster than 0.2 ms, and for this purpose, in an advantageous manner, it is not necessary to have any high current peaks of a booster current. By applying mechanical momentum on the valve-needle by a movable auxiliary body, a system is described that is very simple in its design, and for which significantly simpler electronic circuitry is required for excitation than in the case of the conventional electromagnetic systems in valves.

As a result of the measures described advantageous refinements and improvements of electromagnetically actuated valves are possible.

Further advantages are also to be derived from the following description of the exemplary embodiments.

DETAILED DESCRIPTION

Figure 1:
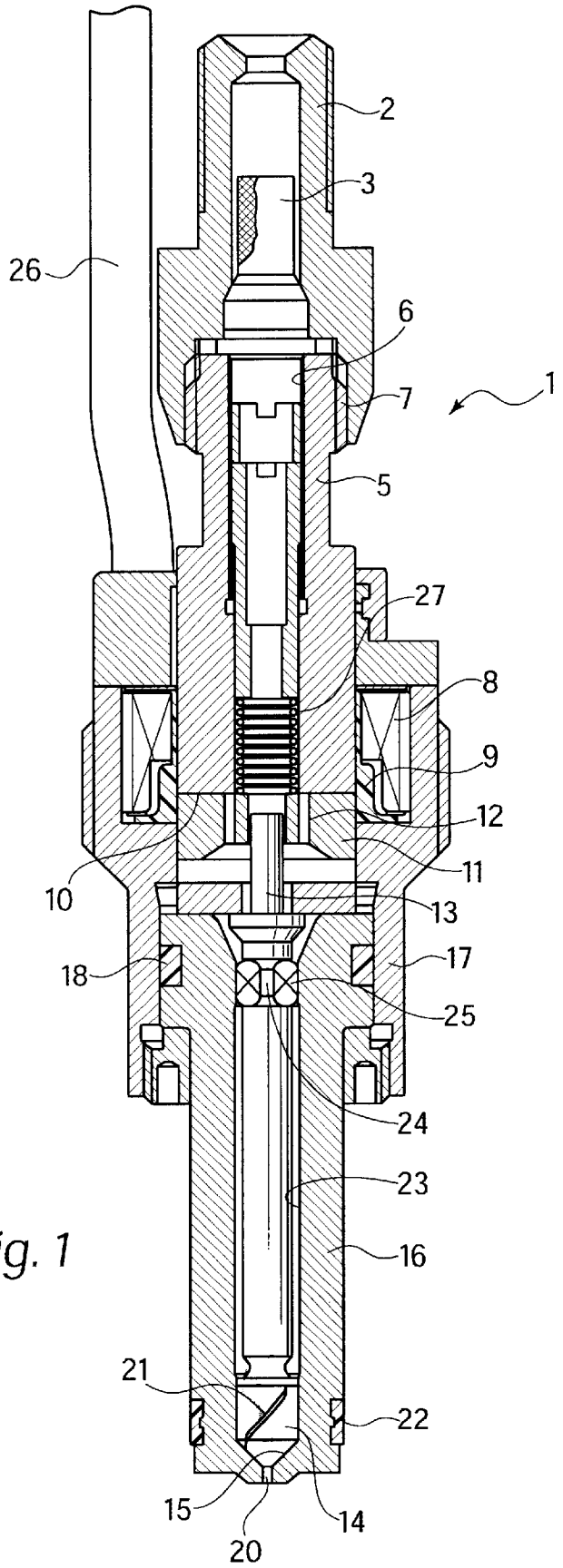
FIG. 1 is a sectional view of a prior art electromagnetically actuated valve as a fuel injection valve.

Before a plurality of exemplary embodiments of an electromagnetically actuated valve according to the present invention is described in conjunction with the FIGS. 2 through 5, depicted in a simplified, symbolic manner, a conventional electromagnetically actuated valve briefly discussed first, in conjunction with FIG. 1, for the purpose of an improved understanding of the invention.

The valve generally given reference numeral 1 has a fuel intake nipple 2, which can be joined via a thread to a fuel line or to a fuel distributor in a conventional manner. Valve 1 is designed in the form of an injection valve for fuel injection systems of mixture-compressing, spark-ignited internal combustion engines, valve 1, depicted by way of example in FIG. 1, is well-suited particularly for the direct injection of fuel into a combustion chamber (not shown) of the internal combustion engine. The fuel arrives via a fuel filter 3 into a longitudinal bore 6 configured in a core 5. Core 5 has an external thread segment 7, which is screwed into fuel intake nipple 2.

Core 5 at its downstream end 10 is at least partially surrounded by a solenoid coil 8, which is wound on a coil holder 9. Downstream of end 10 of core 5, an armature 11 is located at a distance formed by a small gap from end 10. Armature 11 has bore holes 12 for the passage of the fuel. Armature 11 is fixedly joined, e.g. by welding, on a valve needle 13. At the end opposite armature 11, valve needle 13 has a valve-closure member 14, which cooperates with a valve seat 15 configured on a valve seat support 16. As depicted in FIG. 1, valve seat support 16 is inserted into a housing body 17 and is sealed by a sealing ring 18.

Housing body 17 can be screwed, using a thread, into a cylinder head (not shown) of an internal combustion engine. When valve 1 is opened, fuel is injected into a combustion chamber (not shown) through at least one spray-discharge opening 20, configured at the downstream end of valve seat support 16. For the purpose of better distributing and preparing the fuel, there is, e.g., a plurality of swirl grooves 21 introduced circumferentially on valve-closure member 14. For sealing off valve seat support 16 in the bore hole of the cylinder head, there is a seal 22, applied circumferentially. Valve needle 13 is guided in a longitudinal opening 23 of valve seat support 16 by guide surfaces 24. Between guide surfaces 24 there are Flattened off areas 25 to make possible the unhindered flow of the fuel.

To open valve 1, solenoid coil 8 is excited as a result of an electrical exciting current, which is applied over an electrical connecting cable 26. In the following description, particularly in conjunction with FIGS. 6 and 7, the electrical excitation is discussed in greater detail. In the resting state of valve 1, armature 11 is acted upon by a restoring spring 27 in opposition to its stroke direction, such that valve-closure member 14 on valve seat 15 is held in sealing contact. When solenoid coil 8 is excited, armature 11 is pulled toward core 5 in the stroke direction, the stroke being stipulated by the gap formed between core 5 and armature 11. Valve needle 13, fixedly joined to armature 11, and valve-closure member 14 are carried along together, as an axially movable valve element, in the stroke direction, so that valve-closure member 14 releases spray-discharge opening 20. When the excitation current is switched off, valve element 11, 13, 14 is pressed onto valve seat 15 by restoring spring 27 in the closing direction opposite the stroke direction.

In FIGS. 2 through 5, a plurality of exemplary embodiments of a valve according to the present invention is depicted, the depictions, in each case only in a sectional view, symbolically illustrating the area of the electromagnetic circuit having an axially movable valve needle for opening and closing the valve. In this context, all the exemplary embodiments have in common that, on valve needle 13 between armature 11, fixedly joined to valve needle 13, and valve-closure member 14, forming the downstream end of valve needle 13, an auxiliary body 30 is arranged, which, as a result of measures explained, herein below is moved relative to the valve needle over a small axial range. Auxiliary body 30 on valve needle 13, in this context, is to perform two essential functions: on the one hand, the process of pulling loose valve needle 13 from valve seat 15 and, thus the opening of the valve, is accelerated, and, on the other hand, a high booster current (FIG. 6) which is otherwise required for the pulling loose process, is avoided. As a consequence, the dynamic behavior of the valve is significantly improved and expensive electronic circuitry can be dispensed with.

Figure 2:
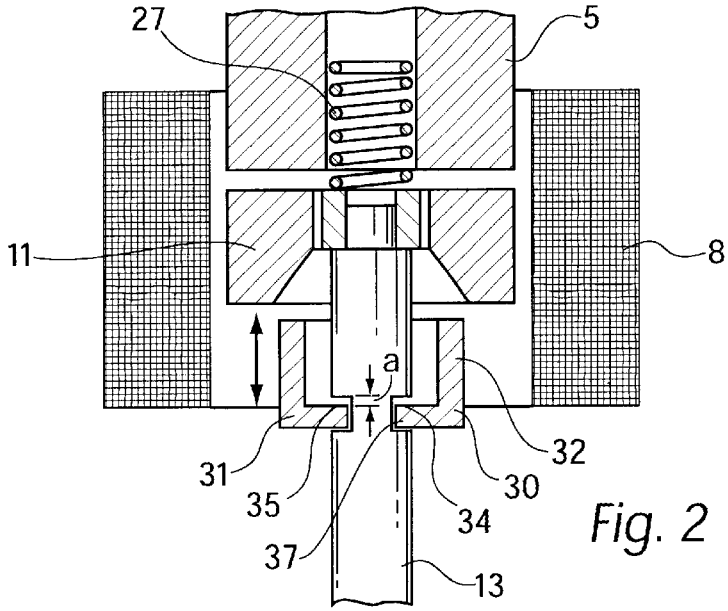
FIG. 2 is a sectional view of a first exemplary embodiment of an auxiliary body according to the present invention.
Figure 3:
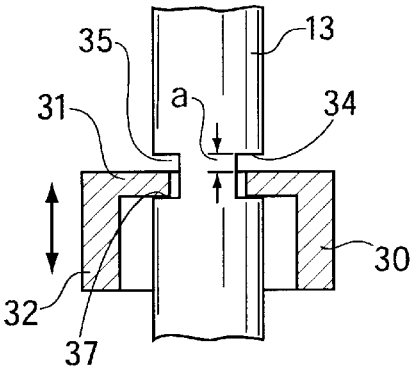
FIG. 3 is a sectional view of a second exemplary embodiment of an auxiliary body according to the present invention.
Figure 4:
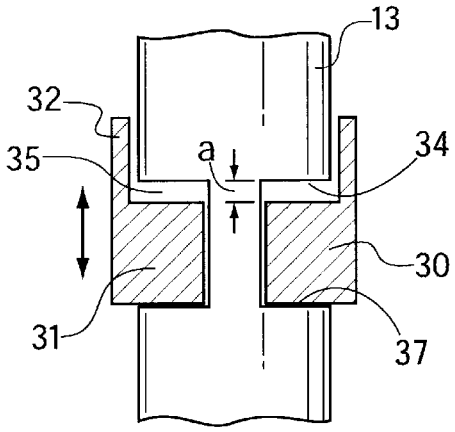
FIG. 4 is a sectional view of a third exemplary embodiment of an auxiliary body according to the present invention.
Figure 5:
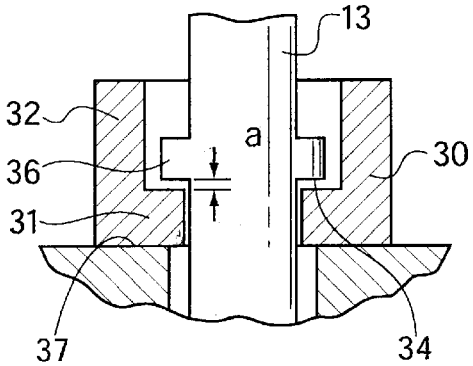
FIG. 5 is a sectional view of a fourth exemplary embodiment of an auxiliary body according to the present invention.

Auxiliary bodies 30 depicted in FIGS. 2 through 5 have a similar structure, among which are a limit stop segment 31 extending, for example, radially, and a circular guide segment 32 extending axially. However, it should be emphasized that specific embodiments of auxiliary bodies 30 deviating also from the depicted examples can also be used. Each limit stop segment 31 of an auxiliary body 30 cooperates with a driving arrangement 34 of valve needle 13. In FIGS. 2 through 4, examples are shown in which driving arrangement 34 is a part of a groove-like notch 35. In these cases, driving arrangement 34 is the upper bordering surface of notch 35, closer to armature 11. In FIG. 5, a valve needle 13 is partially depicted, which, in place of notch 35, has a radially protruding collar, the lower end face, closer to valve-closure member 14, constituting driving arrangement 34 in this case.

In the unexcited state, auxiliary body 30 contacts a resting arrangement 37, and specifically, in the examples of FIGS. 2 through 4, on the lower bordering surface of notch 35 away from armature 11 and, for example, in FIG. 5, it contacts an end face that is fixed on a housing, the end face being, for example, a part of valve seat support 16. As an alternative to the latter configuration, it could be possible to provide for a second undepicted collar on valve needle 13, the collar in its upper end face, facing away from the same armature 11, replacing the end face fixed to the housing as resting arrangement 37, so that the range of motion of auxiliary body 30 is set between two collars 36.

Auxiliary bodies 30 depicted in FIGS. 2 through 5 have a cup-like shape, limit stop segment 31, in each case, constituting a base area, and guide segment 32, in each case, constituting a sleeve area. Guide segment 32 functions to guide auxiliary body 30 during its axial motion, the guide function taking place either at the external periphery of valve needle 13 or along the, wall of longitudinal opening 23. Guide segment 32 can extend either from limit stop segment 31 in the direction of armature 11 (FIGS. 2, 4, 5) or in the direction of valve-closure member 14 (FIG. 3). As is demonstrated in FIG. 4, limit stop segment 31 can have a significantly greater thickness than the wall of guide segment 32. The axial distance between driving arrangement and resting arrangement 37 is, in every case, slightly greater than the axial extension of auxiliary body 30, here in the form of limit stop segment 31, between arrangement 34 and 37, in order to be able to carry out the axial motion already indicated. The gap arising in the resting position of auxiliary body 30 is, designated as a. Limit stop segment 31 or driving arrangement 34 are coated, for example, in order to avoid wear.

Figure 6:
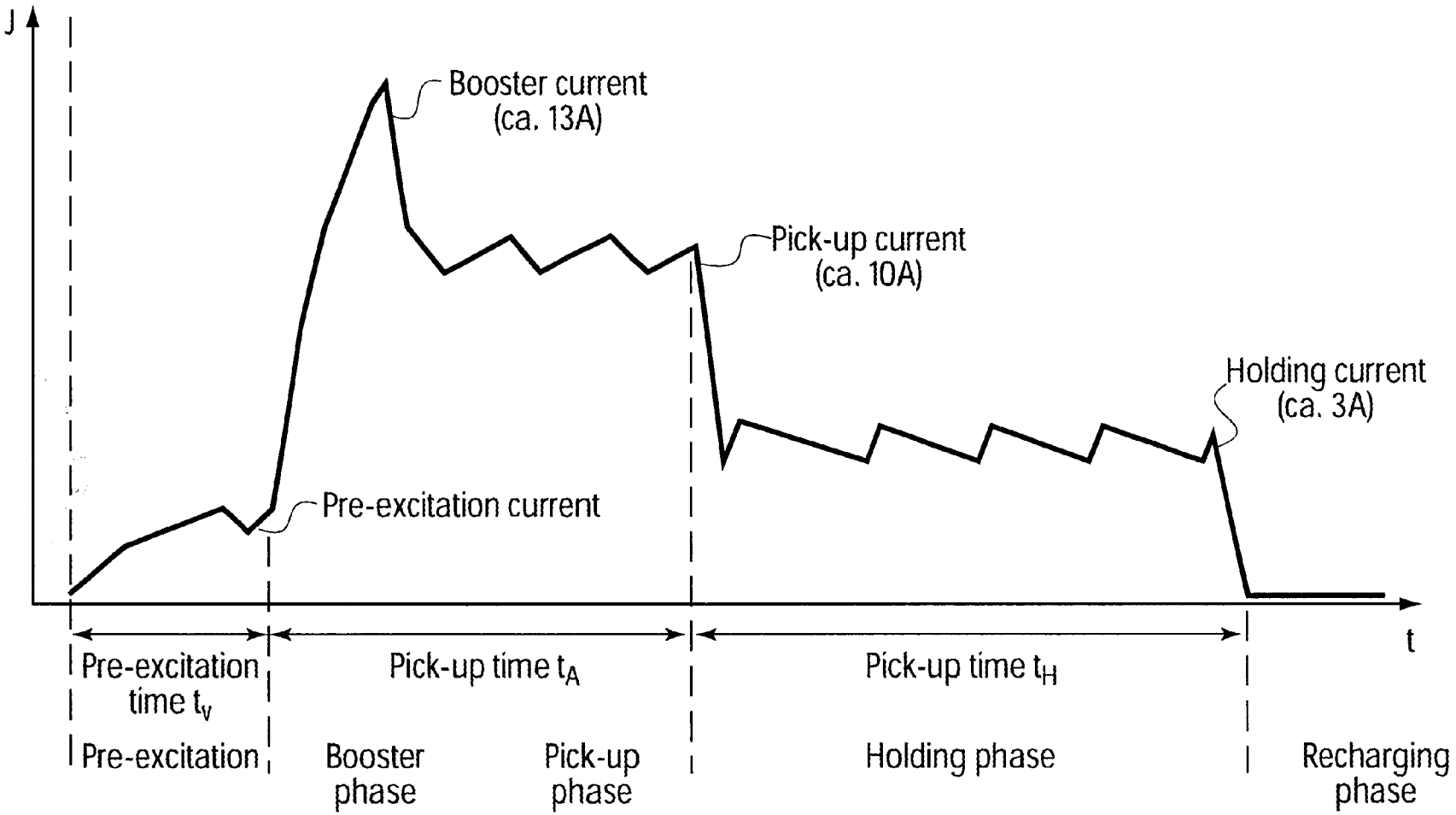
Fig. 6 (Prior Art)
FIG. 6 is a current-time graph for driving a valve.

On the basis of the current-time diagram of FIG. 6, it will now be briefly explained how, in the familiar manner, the excitation takes place for opening a valve, in particular the fuel injection valve depicted in FIG. 1, for direct gasoline injection into the combustion chamber of an internal combustion engine. The valves are driven, e.g., via an output stage switchgear, connected to a control unit, that has available to it a high-quality but costly power electronics. An output stage of this type is designed, e.g., to drive four injection valves, the valve current being set via a clock-pulse current regulation. After a short pre-excitation time $t_V$, the actual opening time follows, a distinction being made between a pick-up time $t_A$ and a holding time $t_W$. During these times, a pick-up current level and a holding current level prevail.

The increased pick-up current level serves to decrease the opening time of the valve. In addition, inside the output stage switchgear, a booster capacitor is charged at a voltage of roughly 120 V. The discharge of the booster capacitor through the electromagnetically actuated valve leads to a steep increase of current (up to roughly 13 A), so that the maximum magnetic force is quickly built up and the valve is opened with similar rapidity. After the valve is completely opened, i.e., the pick-up phase at a valve current of roughly 10 A has terminated, the valve current is reduced by a current regulator to a lower holding current level of roughly 3 A. After the injection has taken place, a recharge phase begins. In this phase, the booster capacitor is recharged to prepare the output stage for the next injection process.

In the embodiment according to the present invention of the valve in accordance with FIGS. 2 through 5, the same positive effects of a rapid opening or of an excellent dynamic behavior of the valve are achieved, it being possible, advantageously, to do without a high booster current for pulling valve needle 13 loose from valve seat 15 and therefore at least partially to do without a power electronics. Overall, the electronic driving process can be simplified. In the valve according to the present invention, the pulling loose of valve needle 13 is accomplished by mechanical momentum. In the electromagnetic field or in one portion of it, auxiliary body 30 having a suitable mass, as indicated in FIGS. 2 through 5, is mounted on valve needle 13. Auxiliary body 30 is accelerated, already at a selectable partial value of pick-up current $t_A$ necessary for excitation, in order to lift valve needle 13 off. This can take place, for example, in opposition go the spring tension of a second restoring spring (not shown), which after every lifting-off, for example, always brings auxiliary body 30 again to its resting position. Using the magnitude of the magnetic field, the mass of auxiliary body 30, and the size of gap a, it is possible to adjust how much energy auxiliary body 30 can yield in striking against driving means 34 of valve needle 13. As a result of the blow-like rebound of auxiliary body 30 at driving means 34 of valve needle 13, valve needle 13 receives corresponding momentum, so that in addition to the pick-up force exerted on armature 11 generated in the magnetic field, a short-term, strong acceleration of valve needle 13 is achieved, and therefore also a rapid opening of the valve.

Figure 7:
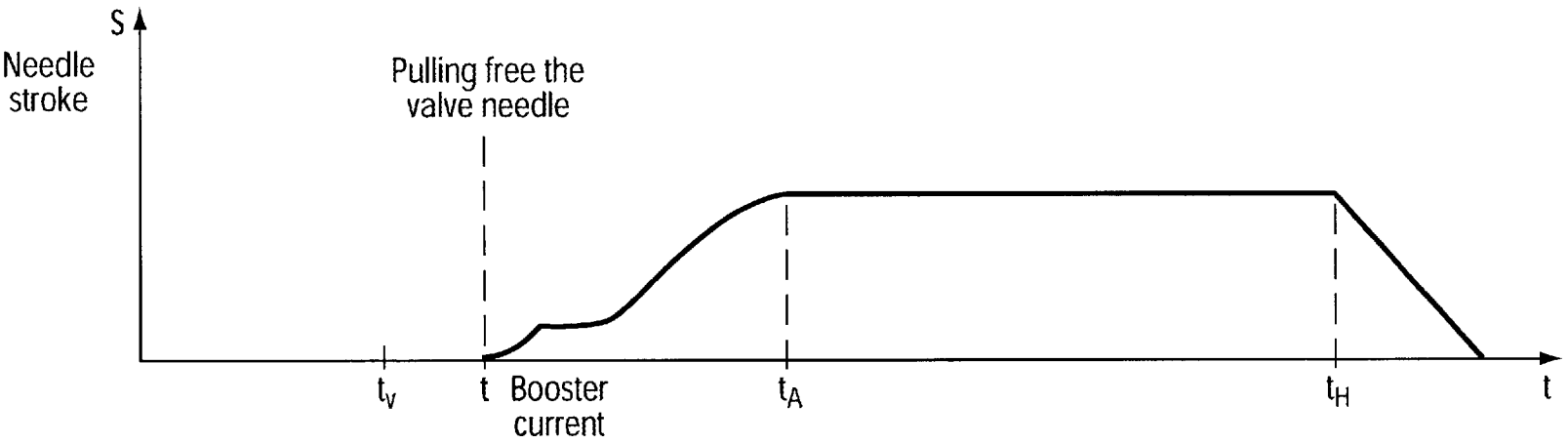
Fig. 7 (Prior Art)
FIG. 7 is a path-time graph illustrating a needle stroke of a valve corresponding to the current-time graph illustrated in FIG. 6.
Figure 8:
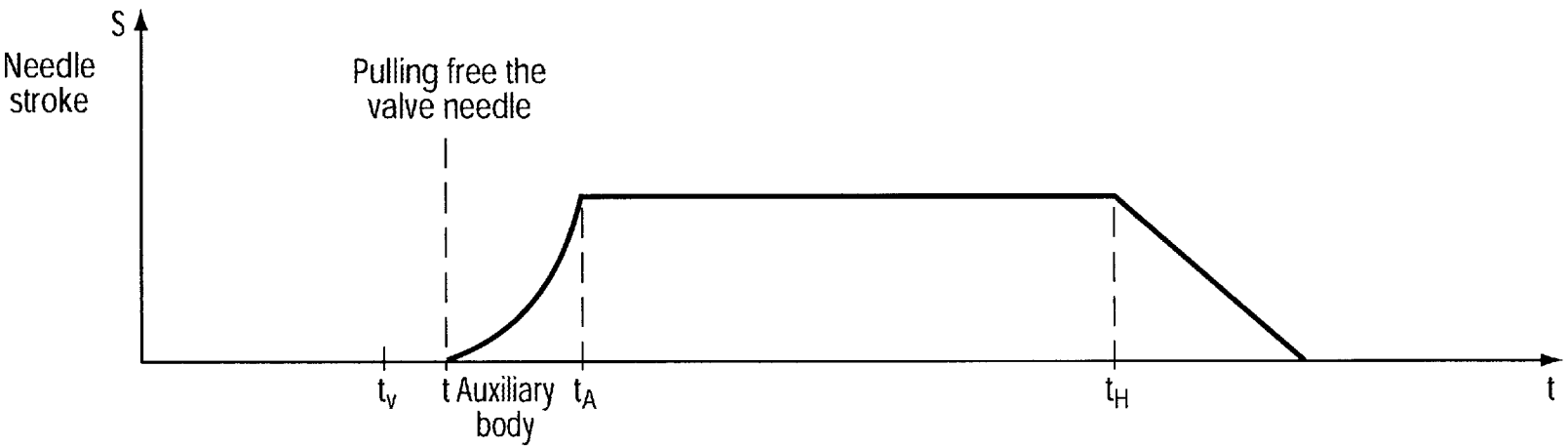
FIG. 8 is another path-time graph illustrating a needle stroke.

In the path-time diagrams of FIGS. 7 and 8, the characteristic curves of the needle stroke are depicted by way of example, it being possible to derive from FIG. 7 a characteristic curve corresponding to a driving process according to FIG. 6 of a conventional valve as in FIG. 1, and from FIG. 8 a characteristic curve of a valve according to the present invention. These diagrams are designed to indicate only that, using an arrangement according to the present invention, it is possible to achieve at least an identical pick-up time $t_A$ or even, as depicted, a shorter pick-up time $t_A$, while doing without a high booster current. The steep rise of the curve after auxiliary body 30 strikes valve needle 13 and after the pulling loose of valve needle 13, associated therewith, are particularly clear. In this manner, pick-up times $t_A$ of less than 0.2 ms can be realized.

What is claimed is:

1. An electromagnetically actuated valve, comprising:

a core;

a solenoid coil;

a first restoring spring;

an armature actuatable by the solenoid coil in a stroke direction in opposition to the first restoring spring;

a fixed valve seat;

a valve-closure member actuatable by the armature, the valve-closure member cooperating with the fixed valve seat;

a valve needle fixedly joined to the armature and the valve-closure member, the valve needle constituting a movable valve element; and an auxiliary body arranged on the valve needle between the armature and the valve-closure member, the auxiliary body being movable relative to the valve needle;

wherein the valve needle and the auxiliary body are configured so that the valve needle is acceleratable in the stroke direction by energy transfer in response to a motion of the auxiliary body in the stroke direction.

2. The valve according to claim 1, wherein the auxiliary body includes a limit stop segment configured to effect the energy transfer to the valve needle.

3. The valve according to claim 2, wherein the valve needle includes an arrangement configured to drive the valve needle in response to a striking against the limit stop segment of the auxiliary body.

4. The valve according to claim 2, wherein the auxiliary body is cup-shaped and includes a guide segment.

5. The valve according to claim 3, wherein the valve needle includes a notch, the arrangement corresponding to a first bordering surface of the notch closest to the armature.

6. The valve according to claim 3, wherein the valve needle includes a collar, the arrangement corresponding to an end face of the collar facing away from the armature.

7. The valve according to claim 5, wherein the notch includes a second bordering surface disposed away from the armature, the notch defining a resting arrangement, the auxiliary body configured to contact the resting arrangement when the valve is closed.

8. The valve according to claim 1, further comprising a second restoring spring configured to press the auxiliary body against a resting arrangement.

9. The valve according to claim 1, wherein the valve is a fuel injection valve configured for direct injection of fuel into a combustion chamber of an internal combustion engine.

* * * * *

UNITED STATES PATENT AND TRADEMARK OFFICE

CERTIFICATE OF CORRECTION

PATENT NO. : 6,450,424 B1
DATED : September 17, 2002
INVENTOR(S) : Michael Horbelt It is certified that error appears in the above-identified patent and that said Letters Patent is hereby corrected as shown below:

Column 2,
Line 11, please delete “In”;
Line 56, change “described” to -- described herein, --;

Column 3,
Line 23, change “briefly” to -- is briefly --;
Line 30, change “engines, valve 1,” to -- engines. Valve 1, --;

Column 5,
Line 4, change “arrangement” to -- arrangement 34 --;
Line 13, change “familiar” to -- conventional --.

Signed and Sealed this

Twenty-fifth Day of May, 2004

JON W. DUDAS
*Acting Director of the United States Patent and Trademark Office*